US006309143B1

(12) United States Patent
Merjan et al.

(10) Patent No.: US 6,309,143 B1
(45) Date of Patent: Oct. 30, 2001

(54) COMPOSITE PILE WITH TAPERING LOWER PORTION AND METHOD FOR DRIVING PILE INTO GRANULAR SOIL

(76) Inventors: Stanley Merjan, 96 Barkers Point Rd., Sands Point, NY (US) 11050; John Dougherty, P.O. Box 688, Franklin Lakes, NJ (US) 07417

( * ) Notice: Subject to any disclaimer, the term of this patent is extended or adjusted under 35 U.S.C. 154(b) by 0 days.

(21) Appl. No.: 09/275,991

(22) Filed: Mar. 25, 1999

Related U.S. Application Data

(60) Provisional application No. 60/086,916, filed on May 27, 1998, and provisional application No. 60/116,643, filed on Jan. 21, 1999.

(51) Int. Cl.[7] ..... E02D 7/14

(52) U.S. Cl. ..... 405/253; 405/231; 405/232; 405/251; 52/169.9; 52/721.4; 52/726.4

(58) Field of Search ..... 405/229, 231–233, 405/250–256; 52/169.9, 721.4, 726.4; 175/19, 435

(56) References Cited

U.S. PATENT DOCUMENTS

| | | | | |
|---|---|---|---|---|
| 975,485 | | 11/1910 | Welsh . | |
| 1,954,070 | * | 4/1934 | Cook | 405/254 |
| 2,151,847 | | 3/1939 | Greulich . | |
| 2,168,269 | | 8/1939 | Orr . | |
| 2,198,985 | * | 4/1940 | Bailey | 405/253 |
| 2,326,872 | | 8/1943 | Marsden . | |
| 2,926,500 | | 3/1960 | Hoppe . | |
| 3,034,209 | * | 5/1962 | Bianca et al. | 29/432 |
| 3,199,300 | * | 8/1965 | Fiore | 405/251 |
| 3,217,459 | * | 11/1965 | Meyer | 52/28 |
| 3,522,707 | | 8/1970 | Fuentes . | |
| 3,664,139 | * | 5/1972 | Sexauer | 405/248 |
| 3,865,498 | * | 2/1975 | Okuto et al. | 52/726.4 X |
| 4,322,181 | * | 3/1982 | Streich et al. | 405/253 X |
| 4,617,768 | * | 10/1986 | Gebelius | 52/726.4 X |
| 4,621,950 | | 11/1986 | Kinnan . | |
| 4,697,959 | | 10/1987 | Kinnan . | |
| 4,915,544 | | 4/1990 | Lin . | |
| 5,438,812 | * | 8/1995 | Erickson | 52/736.3 |
| 5,797,705 | * | 8/1998 | Kellner | 405/253 |
| 5,975,808 | * | 11/1999 | Fujita | 405/253 X |

OTHER PUBLICATIONS

PP. 158 and 159 of "Foundation Construction" By A. Brinton Corson Published 1956 by McGraw–Hill Book Co.

3 Photographs of Transmission Toners in Public Use, (Undated).

* cited by examiner

*Primary Examiner*—David Bagnell
*Assistant Examiner*—Jong-Suk Lee

(57) ABSTRACT

A pile consisting of a tapered bottom section of polygon-shaped steel tubing and a top cylindrical section of steel tubing spliced together to form a composite pile, which, after being driven, is filled with concrete.

27 Claims, 10 Drawing Sheets

COMPOSITE PILE WITH TAPERING LOWER PORTION AND METHOD FOR DRIVING PILE INTO GRANULAR SOIL

CROSS-REFERENCES TO RELATED

This application claims priority of prior provisional applications by Dougherty and Meijan for Composite Pile having Application No. 601,086,916 filed on May 27, 1998 and Application No. 60/116,643 filed Jan. 21, 1999.

FIELD OF THE INVENTION

This invention relates to piling.

1. Description of the Related Art

Present commercial pile driving practice utilizes piles having a variety of materials and geometric shapes to produce capacities in excess of 30 tons (about 270 kN). These piles are often concrete-filled steel tubes having closed-ends that are driven into a variety of soil types, including those with granular (sand and/or gravel) and cohesive (silt and/or clay) characteristics.

Generally, the piles have a constant cylindrical cross-section However, it is well known that a gradually increasing tapered configuration often enhances the load bearing capacity of piles, particularly in granular soils. Thus, piles having such geometries, such as full-length fluted piles with tapered fluted bottom sections below a length of fluted cylindrical tubing having a diameter equal to that at the top of the tapered section, have been shown to be effective by producing higher capacities than cylindrical piles at similar penetrations into these soils. These piles have been used successfully for decades. They are described at pages 158 and 159 of the book "Foundation Construction" by A. Brinton Corson published 1965 by McGraw-Hill Book Company.

2. Brief Summary of the Invention

The piles for this invention have tapered bottom sections made of steel tubing shaped into a polygon cross-section having substantially equal sides (preferably about 8–16, e.g. 12 sides), or of said polygonal cross-section having a short transitional length to a circular cross-section at the top, which is joined by a fabricated splicer, or by butt welding, to conventional circular steel cylindrical pipe having a diameter that may be equal to, or less than, the top diameter of the taper. Wall thicknesses for both the tapered section and pipe section can be up to 0.5 in. (about 13 mm) compared to 0.24 in (about 6 mm) for the conventional fluted piles, top diameters of the tapered section may be from 12 in. (300 mm) to 24 in. (600 mm), bottom diameters may be from 8 in. (200 mm) to 20 (500 mm); tapered lengths may be fabricated in lengths of 5 to 40 feet (1.5 m to 12 m), and circular pipe lengths fabricated to lengths of 80 feet (24 m) and longer. For conventional fluted piles, the splice between the tapered section and cylindrical fluted section is a lap weld from the top of the tapered section to the side of the cylindrical section which has been inserted for several inches into the tapered section, maximum metal thickness is 0.24 in. (about 6 mm), tapered sections have a maximum upper diameter of 18 in. (about 450 mm) and bottom diameters are all 8 in. (about 200 mm), and cylindrical fluted sections are made to a maximum length of 40 ft. (about 12 m)

These piles will produce comparable and greater capacities than the previously described fluted piles.

Among the advantages of these piles are:

1. A wide range of geometries and lengths for the tapered bottoms can be fabricated by means of existing equipment and technology, such as brake-forming. The pile length, top and bottom diameter, and wall thickness can be made to satisfy site-specific pile capacities and soil conditions.

2. Significant cost savings are possible by the use of conventional cylindrical pipe for the tops of these piles. Pipe costs considerably less than fluted cylindrical tubing. Added savings will result if the pipe diameter used is less than the top diameter of the tapered section, and by the re-use of pipe remaining from previously driven piles that can be easily spliced. Furthermore, the use in the practice of this invention of thin-walled pipe (or, alternatively, corrugated steel shell) that is driven with an internal mandrel will also produce significant cost-savings.

3. Specific design considerations not possible with existing configurations of piles having tapered bottoms may be designed for using the proposed piles. These include tapered and pipe wall thicknesses of up to 0.5 in. (about 13 mm) to provide stiffness and suitable stress levels for both driving conditions and service conditions. Heavier wall thicknesses may be used for the proposed piles to avoid damage often caused to fluted tapered piles with available maximum wall thickness. Added pile stiffness and strength also improves the driving efficiency thereby yielding improved pile load carrying capacity.

4. The splices for these piles may be drive-fit, weld-fit, or butt-welded. In all cases, the load transfer from the top of the pile to the bottom is made by continuous bearing of each of the components, and not through a shear transfer in a lap-welded splice as is customary for fluted piles. The convenience, effectiveness, and economy of these splices will make it possible to perform more splicing at the job site, thereby allowing the preferable and less costly shipment of shorter lengths.

5. The circular cylindrical pipe sections of these piles may be manufactured in lengths to 80 feet (about 25 m). Thus, the splicing of the pipe to a typical tapered section of 25 feet (about 8 m) will produce an overall length of up to 105 feet (about 33 m). Additional sections of pipe may be conveniently added, if needed, by the use of butt-welded splices or mechanical sleeves. Fluted piles generally have a fabrication length limitation for the cylindrical sections of 40 feet (about 12 m) which, with tapered lengths of 25 feet (about 8 m), will produce overall lengths of up to only 65 feet (about 20 m). Additional piling length requires costly splicing of the fluted cross-section. Thus, the use of the piles of this invention piles will often eliminate costly added splices when the total pile lengths are longer than 65 feet, and allow for effective and efficient splicing if needed at any length.

DETAILED DESCRIPTION OF THE INVENTION

Figure 1:
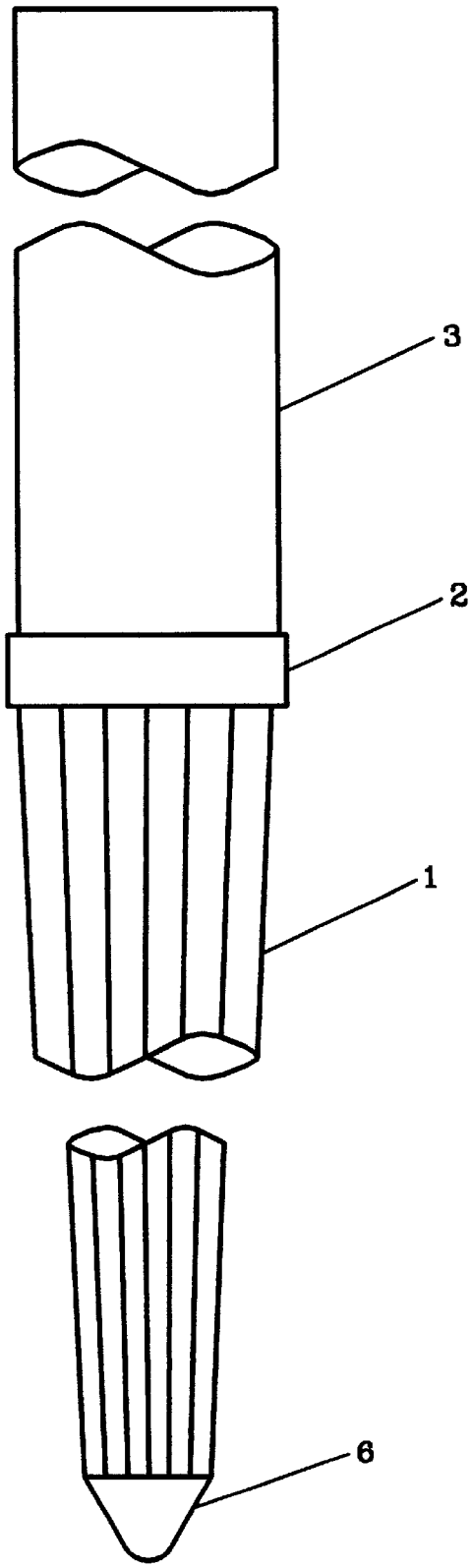
FIGS. 1, 2 and 12 are each elevations of composite piles of this invention

These piles may be produced in a great variety of configurations to suit particular conditions of soil profiles and capacity requirements. Examples are:

A pile having a 10 foot (about 3 m) long tapered section of 0.188 inch (about 5 mm) thick steel with a bottom diameter of 8 inches (about 200 mm) and a top diameter of 12 inches (about 300 mm), and connected to an 8⅝ inch (about 220 mm) O.D.×.188 inch (about 5 mm) thick pipe having a length of 30 feet (about 10 meters) may be used to produce a capacity of 40 tons (about 360 kN) when driven to penetrate through 5 feet (about 1.5 m) of miscellaneous fill, 20 to 25 feet (about 6 to 8 m) of organic silt, and 10 feet (about 3 m) or so into a lower loose sand or medium soft clay stratum having an "N" value of about 15.

Or, a pile having a 25 foot (about 8 m) long tapered section of 0.312 inch (about 6 mm) thick steel formed into a tapered structure having 12 substantially equal faces, the upper outside diameter of the tapered section being about 18 inches (about 460 mm) across and its lower outside diameter being about 8 inches (about 200 mm) across, the very top of the tapered section being deformed into a circular cross-section of 18 inch (about 460 mm) outside diameter and butt-welded to an 18 inch O.D.×0.375 inch (about 10 mm) thick pipe having a length of 40 feet (about 12 m) may be used to produce a capacity of 150 tons (about 1330 kN) when driven to penetrate through 10 feet (about 3 m) of dredged sand, 5 feet (about 2 m) of organic soil, and 45 to 50 feet (14 to 16 m) into a loose to medium dense sand stratum having a standard penetration value that varies between 10 and 30.

In general, the length of the tapered section should be such as to fully develop the capacity of the pile in the bearing stratum, which is usually a granular soil such as sand, gravel, or a combination thereof. The pipe will have the length necessary for the pile to extend up to the bottom of the foundation (i.e., pile cap or grade beam) for the structure above.

These piles must have a suitable thickness and yield strength to accommodate any dynamic stresses generated during the driving. Pile driving criteria to establish the requisite pile capacity at acceptable driving stresses may be predetermined by wave equation analysis, and load testing may be done to confirm capacity. After driving, the piles are filled with concrete. Generally, it is not necessary to use reinforcement in the concrete, e.g., the internal reinforcing steel cage often employed in conventional fluted steel piles may be omitted, as may the reinforcement often necessary (to prevent buckling during driving) at the tops of the fluted sections of the conventional piles. Where piles are to be driven into corrosive soils additional steel thickness may be used to offset projected loss to corrosion instead of applying an expensive coating to the steel as is done for the conventional fluted piles. The preferred thicknesses of steel for these piles is between 0.188 inches (about 5 mm) to 0.500 inches (about 13 mm). The steel may be mild steel (suitable for welding) with a yield strength of about 50 KSI (3.54 kPa). The combined strength of the steel and concrete must satisfy the design capacity requirements.

The figures (FIG. 1 through FIG. 15) that are shown describe certain preferred forms of the invention.

FIG. 1 is an elevation of the composite pile having a tapered lower section 1 with a regular polygonal cross-section of a number of equal sides joined by a transition ring 2 to a circular pipe 3 whose diameter is approximately equal to the diameter of the top of the taper and whose thickness is suitable for direct driving. A steel point 6 has a taper of about 60 degrees, or may be rounded, is welded to the bottom of the tapered lower section for closure. A flat plate may be used in lieu of the tapered or rounded point.

Figure 2:
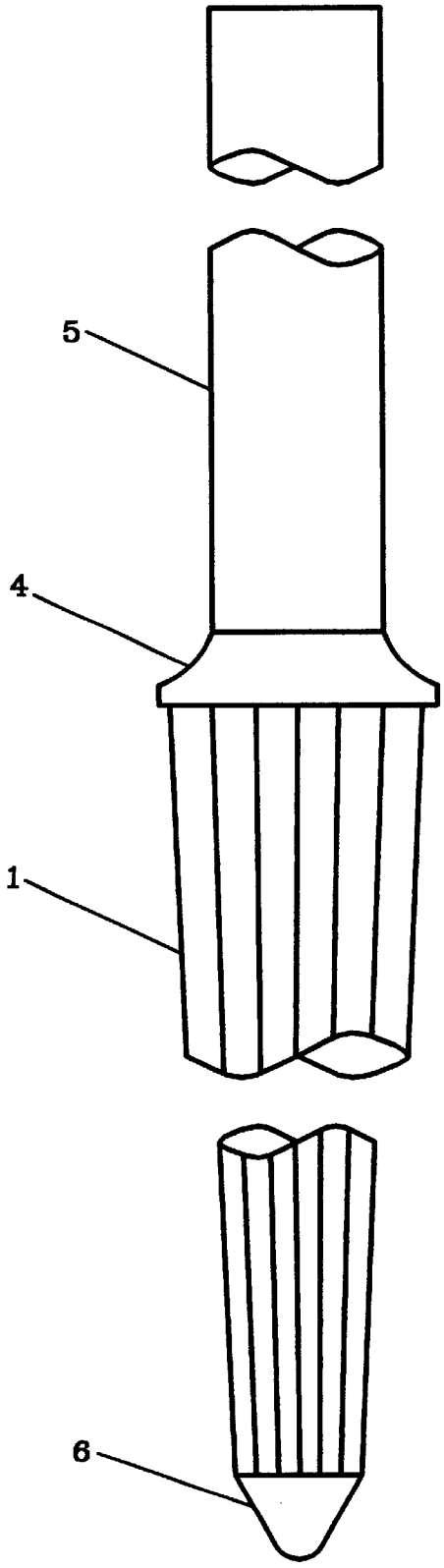

FIG. 2 is an elevation of the composite pile having a tapered lower section 1 with a regular polygonal cross-section of a number of equal sides joined by a transition ring 4 to a circular pipe 5 whose diameter is less than the diameter of the top of the taper and whose thickness is suitable for direct driving. A point 6 is welded to the bottom of the tapered lower section for closure.

Figure 3:
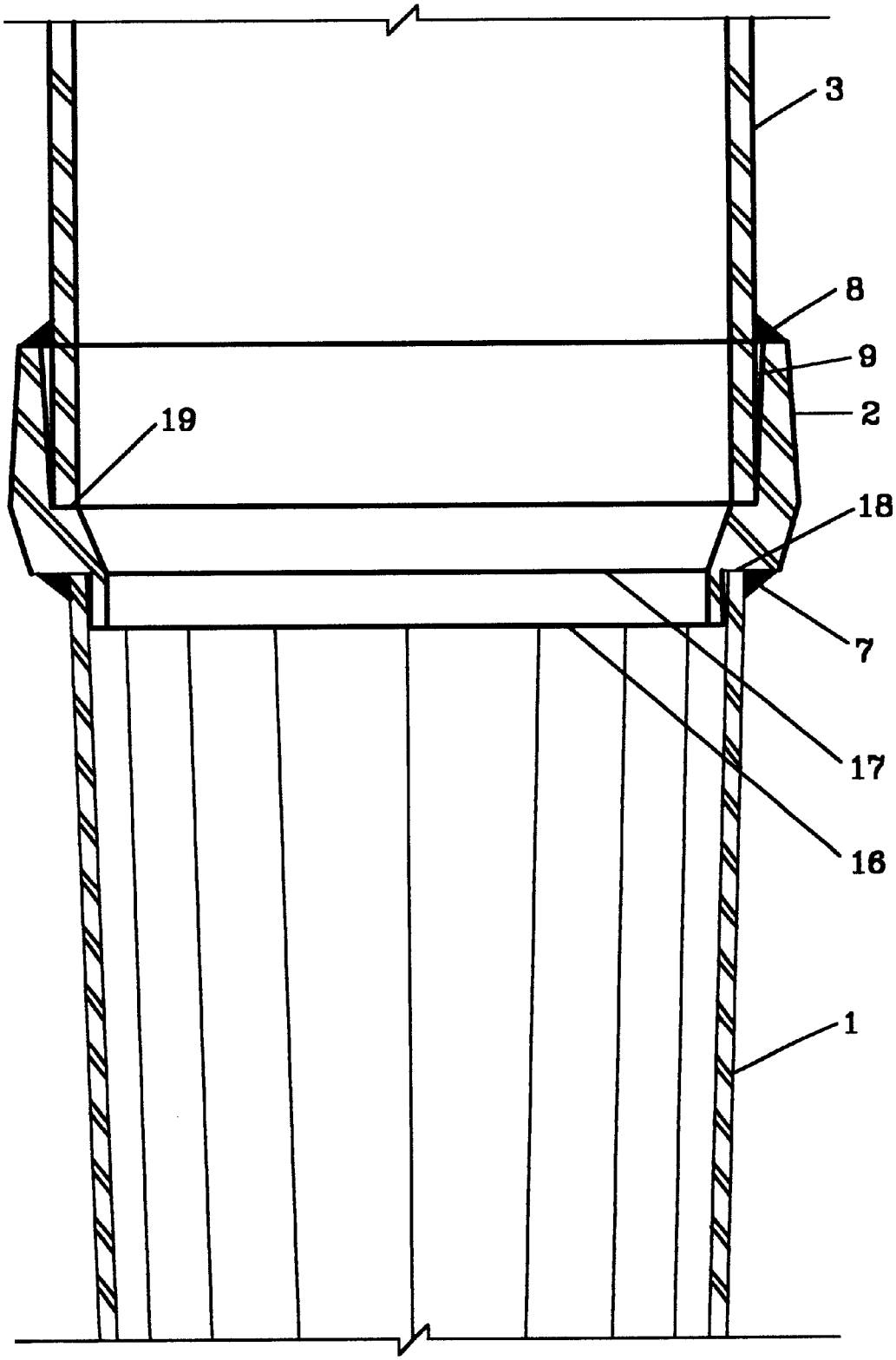
FIGS. 3, 4 and 5 are each cross-sectional details showing connections between the upper and lower sections of the piles.

FIG. 3 is a cross-sectional detail showing the transition ring 2 joining the tapered lower section 1 to the circular pipe 3 as described for FIG. 1. These are joined by continuous welds 7 and 8. The transition ring 2 has a lower portion 16, of polygonal cross-section to fit snugly into the top 17 of lower section 1, which bears on an integral shoulder 18. The integral socket 9 into which the pipe 3 fits may be configured to produce a "drive-fit" connection with no weld. The pipe bears on an integral shoulder 19. The pile is driven by the blows of a conventional pile driving hammer applied to the top of pipe 3.

Figure 4:
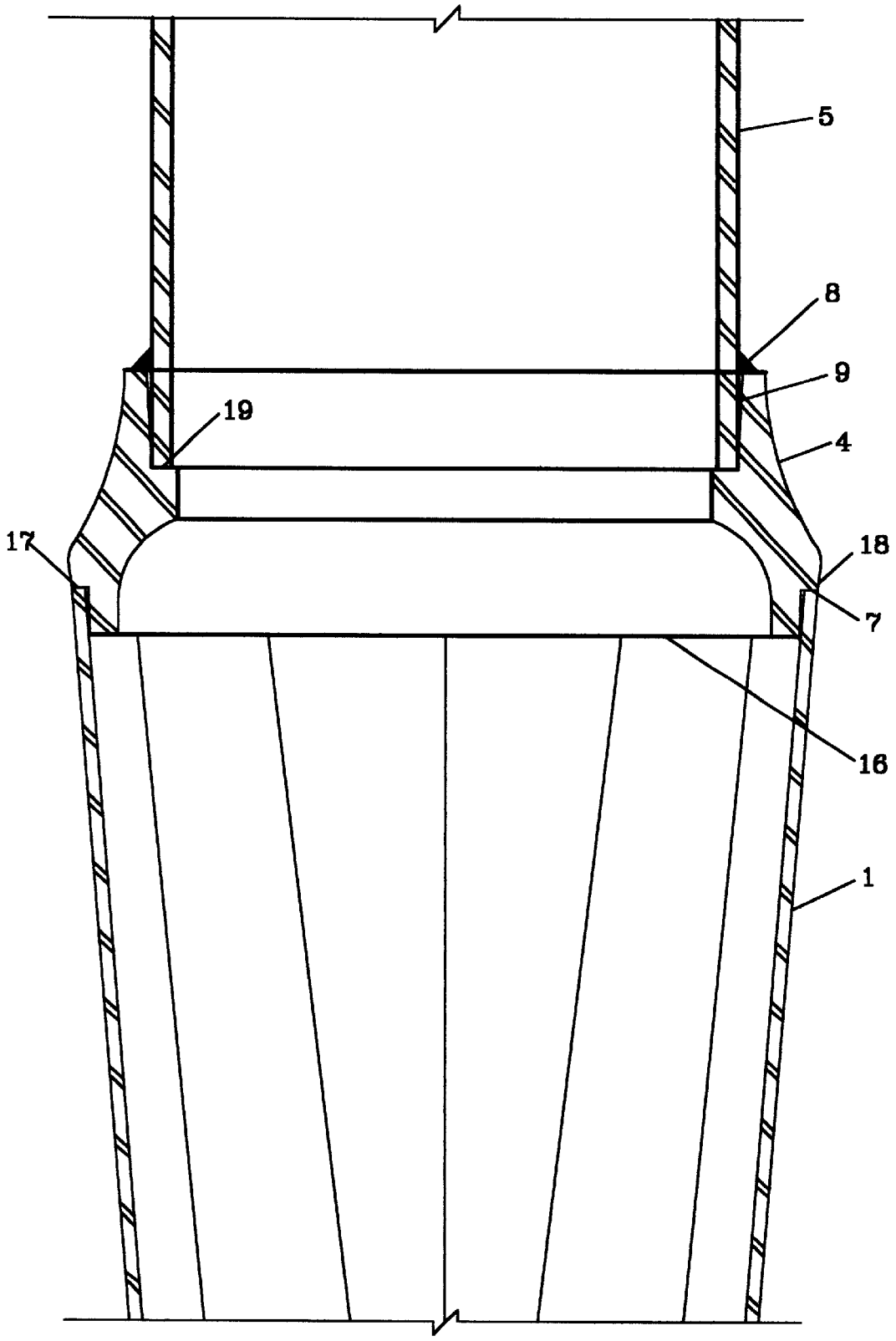

FIG. 4 is a cross-sectional detail showing the transition ring 4 joining the tapered lower section 1 to the pipe 5 having a diameter smaller than that for the top of 1 as described for FIG.2. These are joined by welds 7 and 8. The transition ring 4 has a lower portion 16, of polygonal cross-section to fit snugly into the top 17 of lower section 1, an integral shoulder 18. The integral socket 9 into which the pipe 5 fits may be configured to produce a "drive-fit" connection with no weld. That pipe bears on the upper part of the shoulder 19. The pile is driven by the blows of a conventional pile driving hammer H applied to the top of pipe 5.

Figure 5:
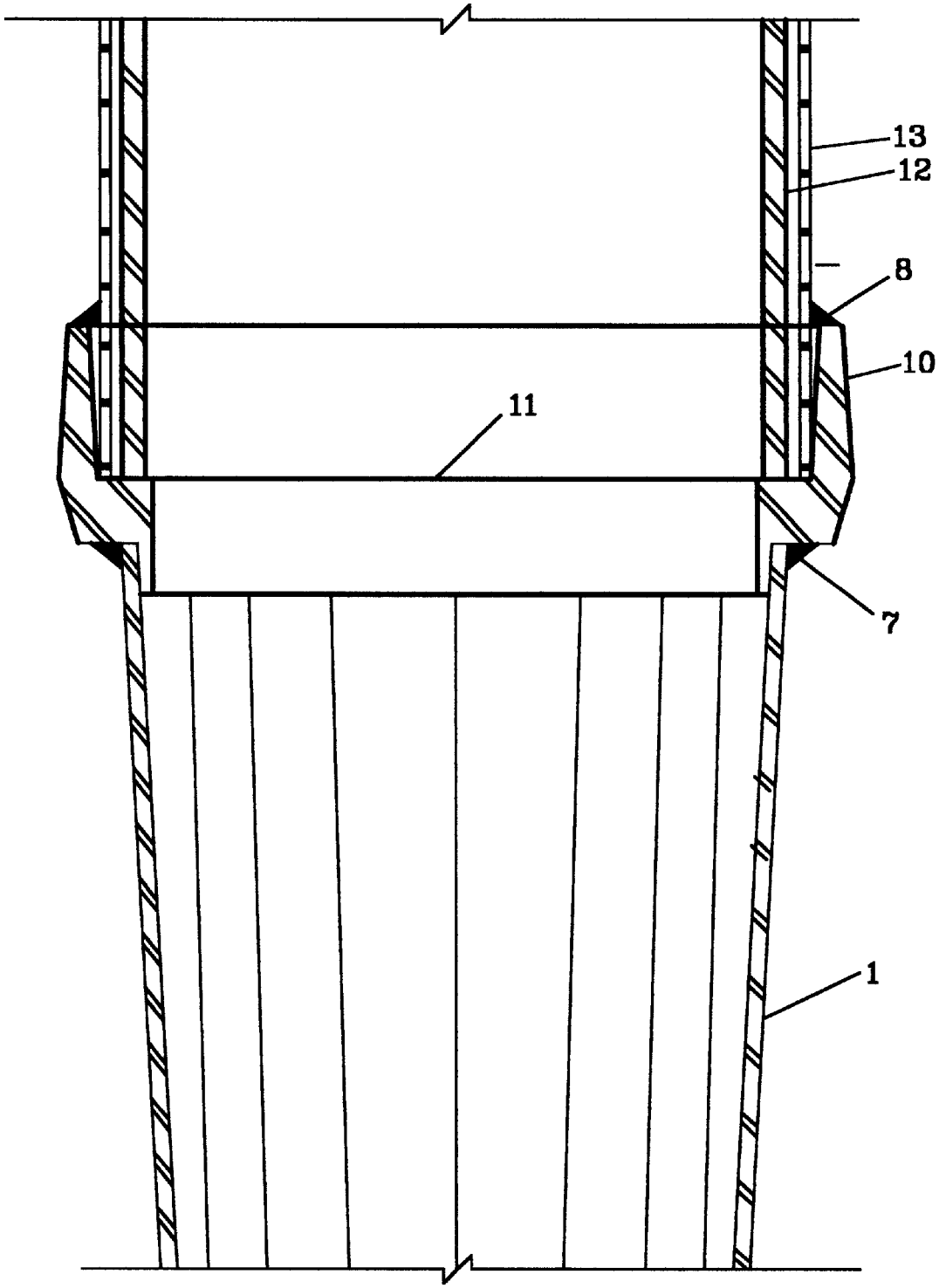

FIG. 5 is a cross-sectional detail of a pile whose upper portion is a thin-walled steel pipe 13. The pile is driven by pile driving hammer blows to the top of a conventional pipe mandrel 12 which fits inside the thin-walled steel pipe and rests on an extended inner drive shoulder 11 of the transition ring 10. These are joined by continuous welds 7 and 8.

Figure 6:
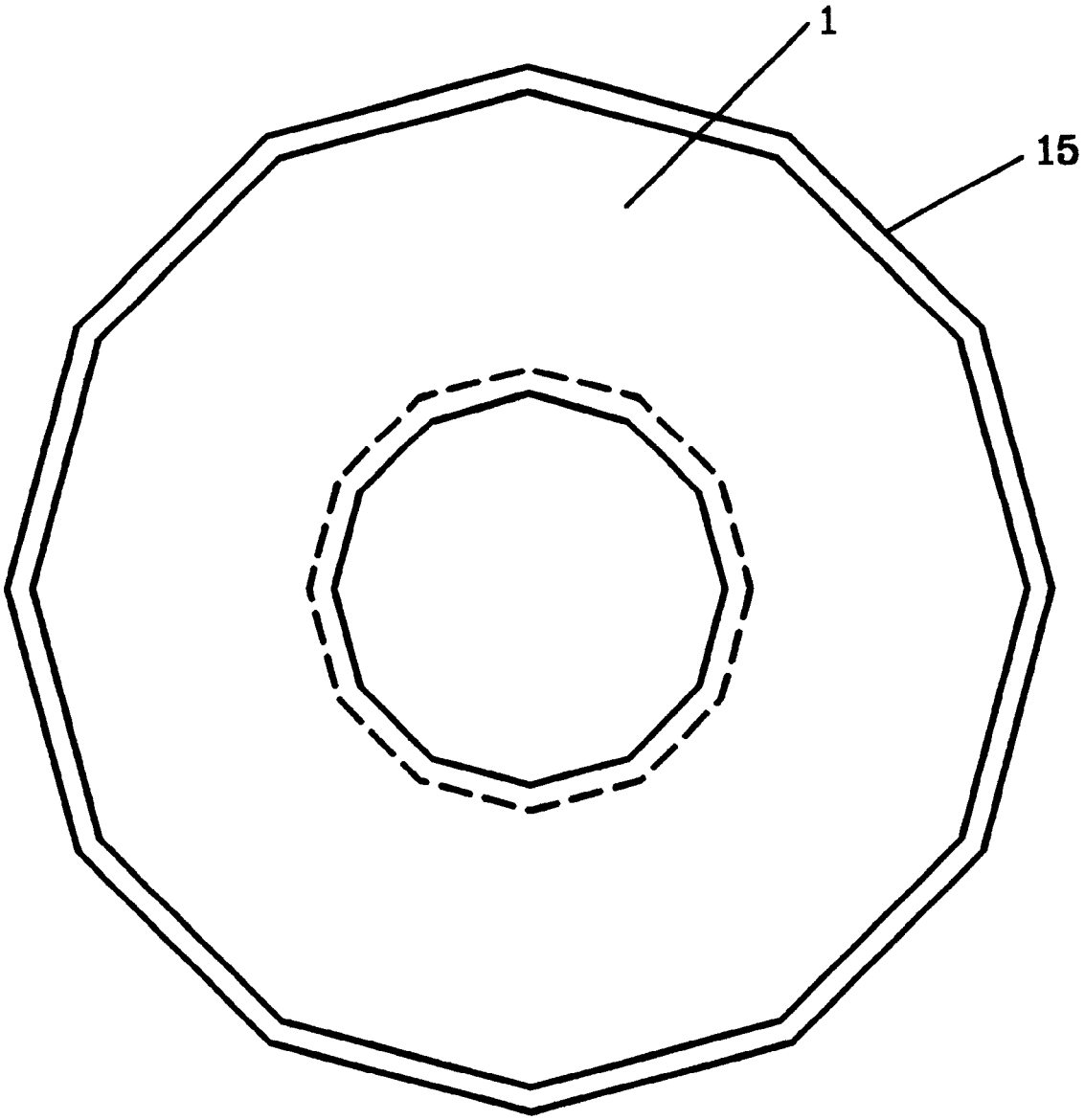
FIG. 6 is a plan view of the bottom section.

FIG. 6 is a plan of the tapered bottom 1 viewed from the top. This cross-sectional shape is a polygon having 12 sides 15 of equal length. The number of sides can vary from 4 to 16 or more.

Figure 7:
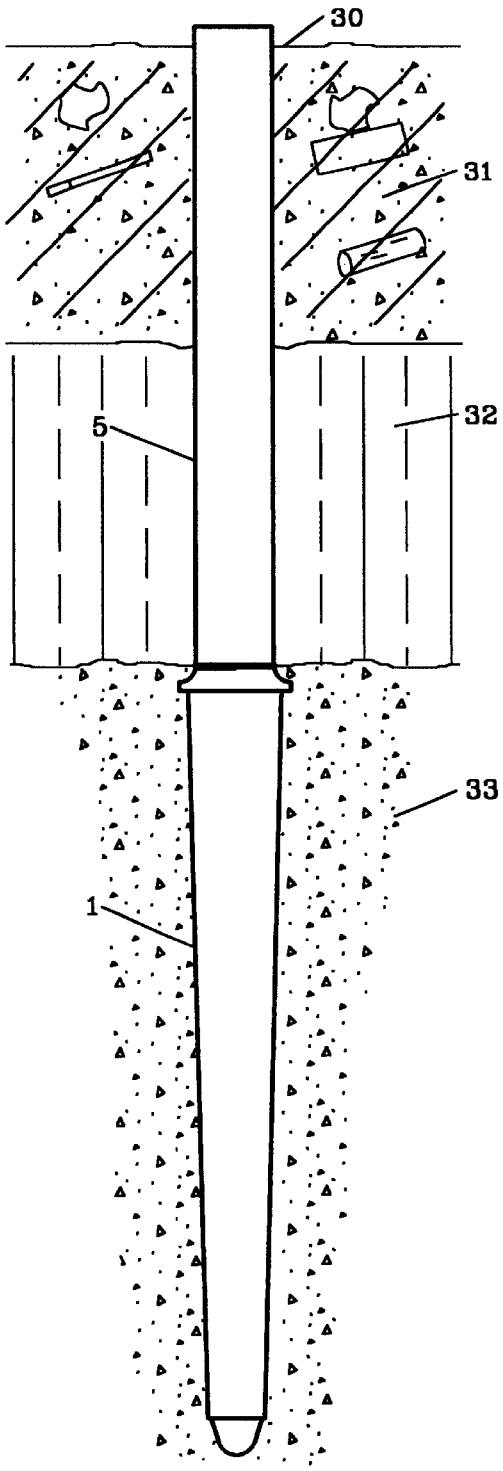
FIGS. 7 and 8 are elevations showing fully driven piles.

FIG. 7 is an elevation showing a fully driven pile 30 driven through upper soils of miscellaneous fill 31 and organic silt 32 into a stratum of loose to medium sand and gravel 33. The tapered lower section 1 of the pile is usually fully embedded in stratum 33, and the upper section, 5, is made of cylindrical pipe having a diameter smaller than the top of the tapered lower section 1 which extends through the fill and organic silt, and usually for some distance into the lower sand and gravel.

Figure 8:
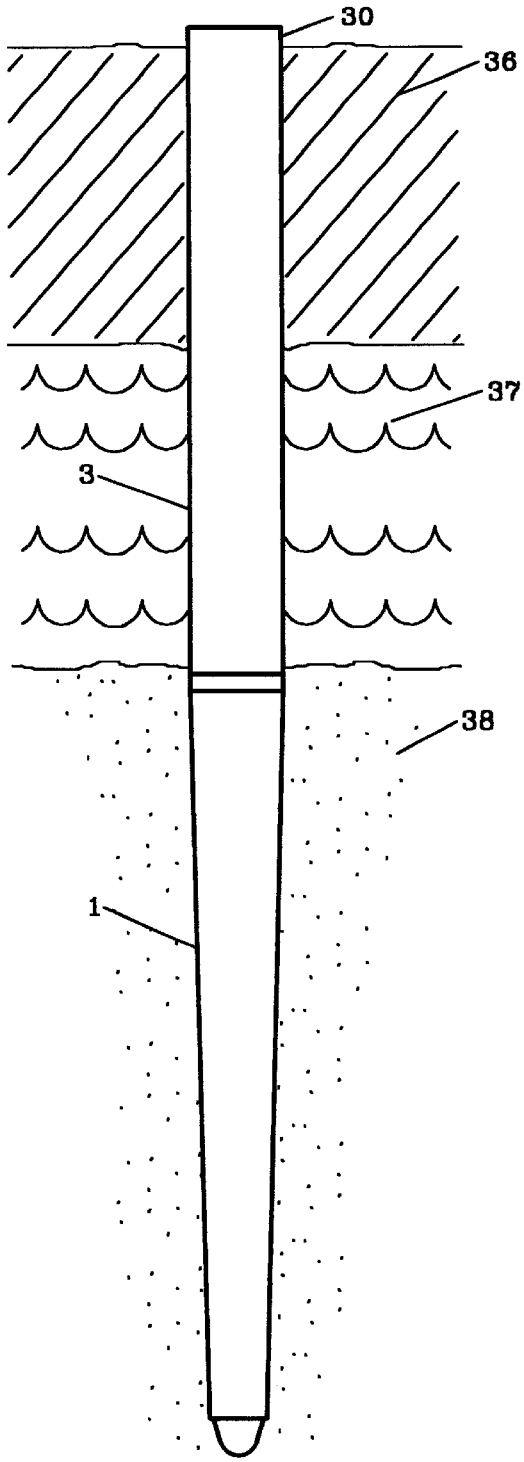

FIG. 8 is an elevation showing a fully driven pile 35 driven through upper soils of soft clay 36 and peat 37 into a stratum of to medium to dense sand 38. The tapered lower section 1 of the pile is usually fully embedded in stratum 36, and the upper section, 3, is made of cylindrical pipe having a diameter approximately equal to the top of the tapered lower section 1 which extends through the clay and peat, and usually for some distance into the lower sand and gravel.

Figure 9:
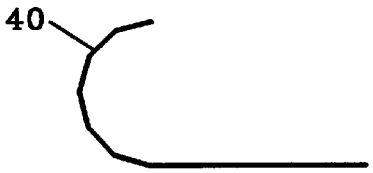
FIG. 9 is a transitory view during the formation of the tapered polygon.

FIG. 9 is a view of a partially formed polygon 40 during fabrication. A section of steel plate is cut to the requisite dimensions, and shaped by a brake-forming machine into an equal-sided polygonal tube having a uniform taper.

Figure 10:
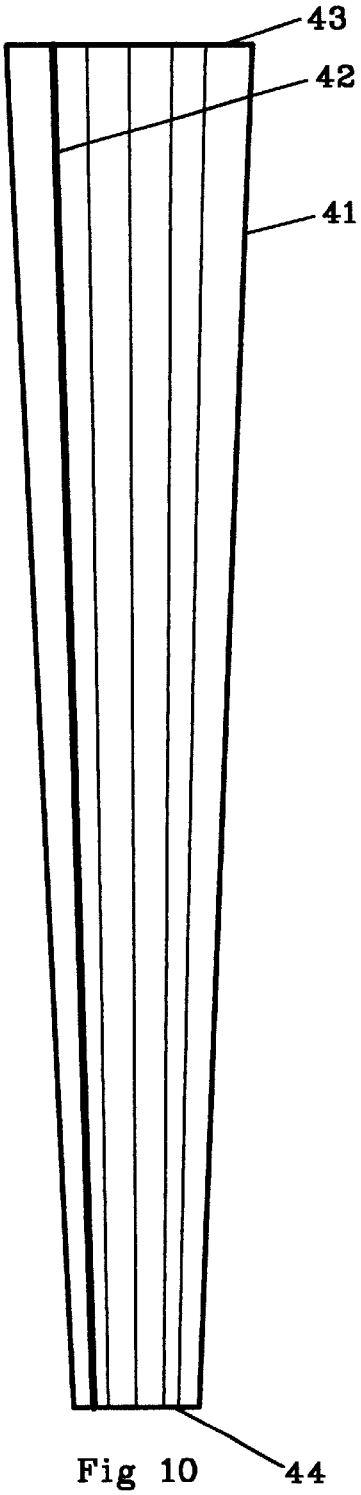
FIG. 10 is an elevation of the tapered tube.

FIG. 10 shows a full length of tube 41 after being formed. A continuous longitudinal weld 42 is made and the ends 43 and 44 are trimmed square to complete the tubular form. The tube may be made of a single sheet of steel for lengths of 25 feet (about 8 m) or more.

Figure 11:
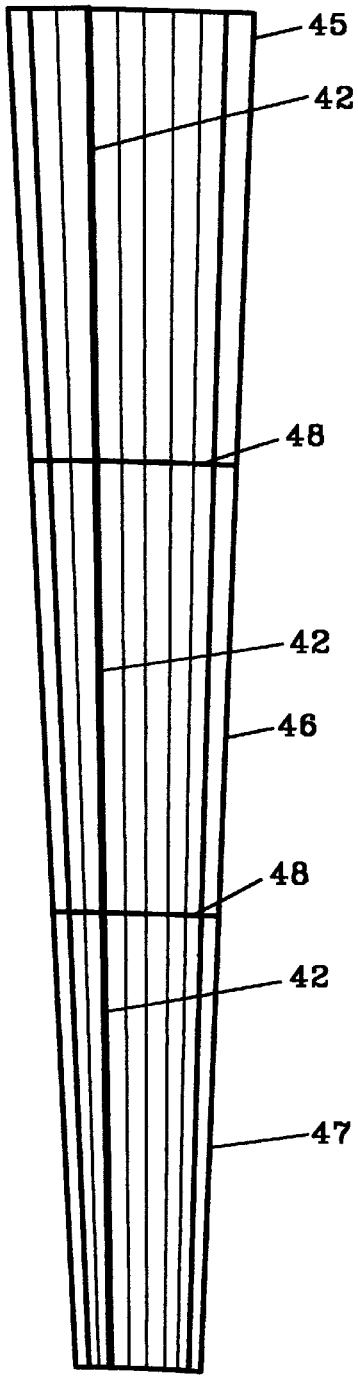
FIG. 11 is an elevation of a tube made of shorter sections.

FIG. 11 shows a tube made of several shorter sections of matching tubes 45, 46, and 47 which are joined together by transverse butt welds 48 to yield lengths of 30 (10 m) feet or more (e.g., 80 feet–about 25 m)

Figure 12:
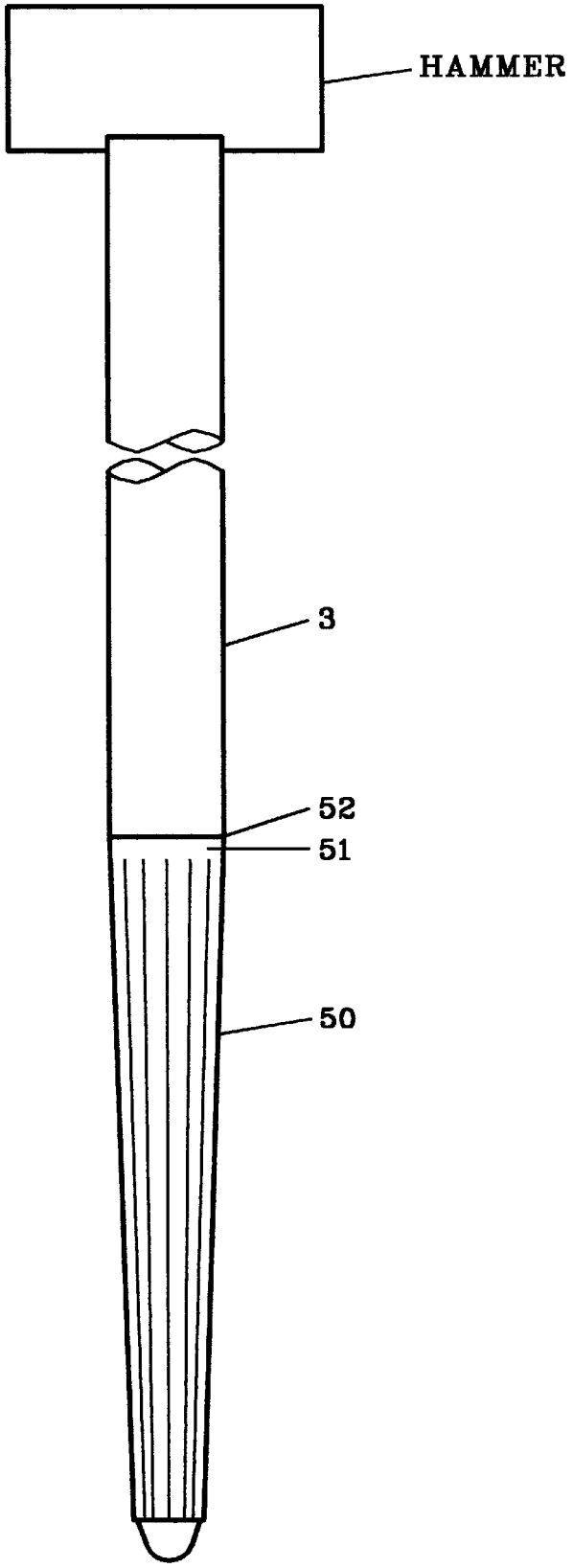

FIG. 12 shows a full pile having a tapered tube 50 of polygonal cross-section for all of its length except at the very top where there is an integral transitional length of tube 51 of circularized cross-section to match the inner (or outer) diameter of the circular pipe, 3. A butt-weld 52 splices the two sections together. This circularization may be effected by inserting an expandable die into the large end of the polygonal structure to cold work and expand that end into the circular form. The whole transition from polygon to circular cross-section may extend over a very short lengths of the structure, e.g., about 1 inch (about 25 mm).

Figure 13:
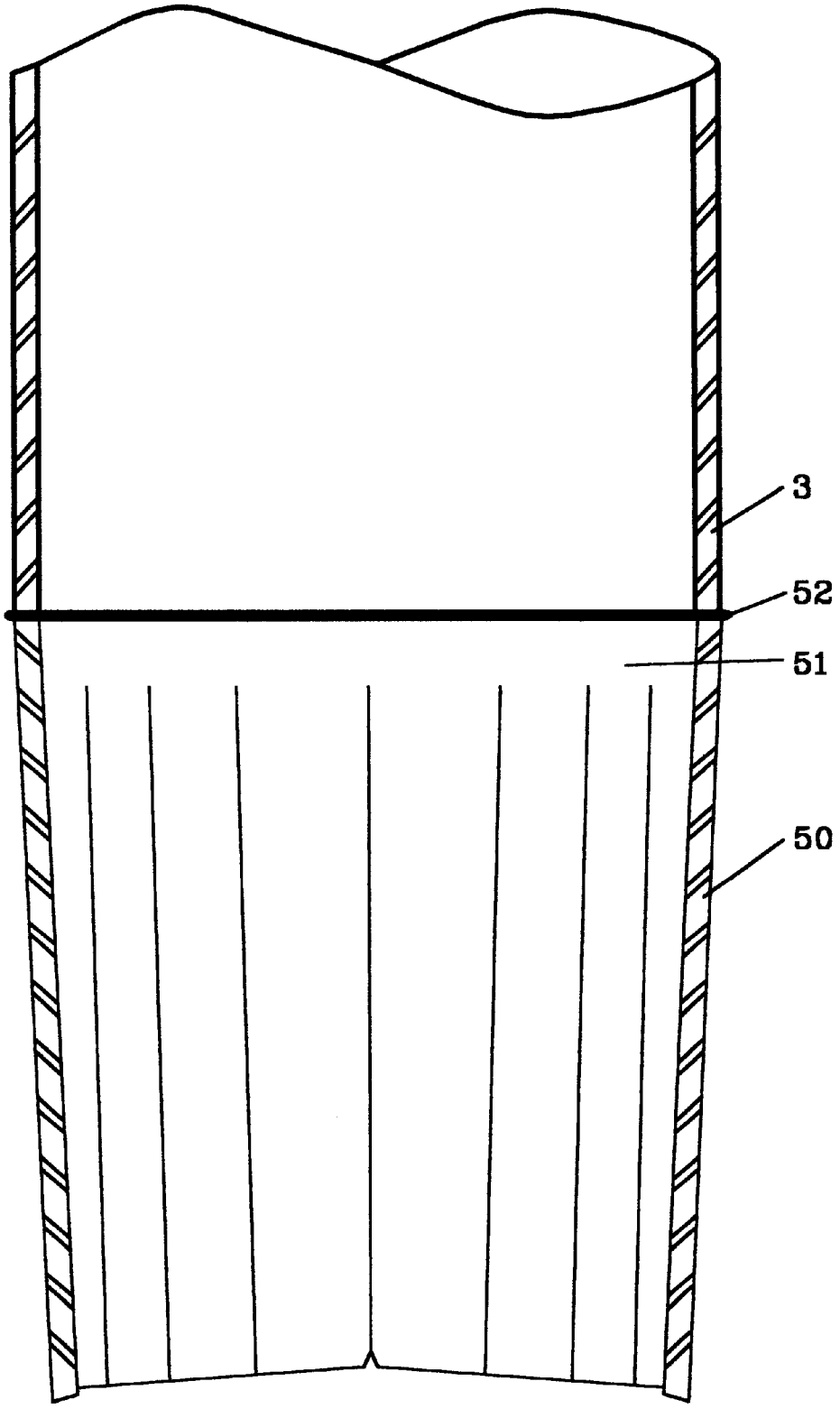
FIG. 13 shows a butt weld joining the sections.

FIG. 13 shows the butt weld 52 joining the circular top 51 of the tapered tube 50 to the circular pipe 3.

Figure 14:
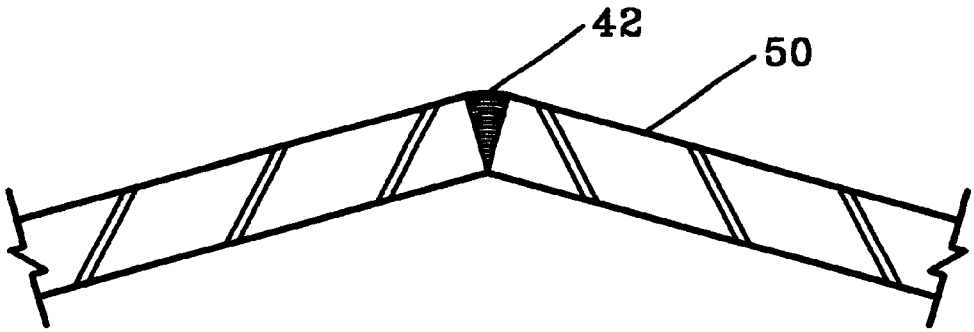
FIG. 14 is a transverse cross-section through the butt weld.

FIG. 14 shows a transverse cross-section through the longitudinal butt weld 42 joining the outside edges the folded plate of the tapered tube 50.

Figure 15:
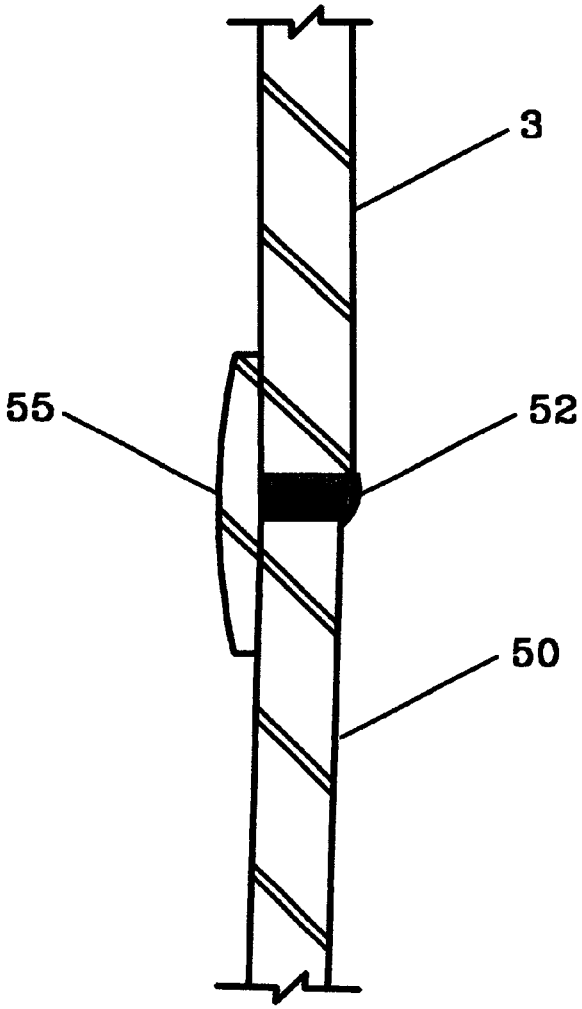
FIG. 15 is a longitudinal cross-section showing the butt weld splice.

FIG. 15 shows a longitudinal cross-section showing the butt weld splice 52 joining the tapered tube 50 to the pipe 3. Internal backing ring 55 is used to contain the weld metal.

It is understood that the foregoing detailed description is given merely by way of illustration and that variations may be made without departing from the spirit of the invention. The "Abstract" which follows is given merely for the convenience of technical researchers and is not to be given any weight with respect top the scope of the invention.

We claim:

1. In a pile having (a) a hollow uniformly tapered bottom load-bearing portion for extended engagement with the soil into which the pile is to be driven and to be filled with concrete after driving and (b) a hollow straight upper load-bearing portion, the improvement in which the said hollow tapered portion has a cross-section, taken perpendicular to a longitudinal axis, which is a convex polygon having at least four sides, said sides being substantially equal in length, said hollow straight portion has a cross-section, taken perpendicular to a longitudinal axis, which is circular, the very top end of said hollow tapered portion being formed to a circular cross section of substantially the same diameter as, and matching with, the cross-section of said hollow straight portion and the bottom end of said hollow straight portion being butt-welded to said top of the hollow tapered portion so that the load transfer from the top of the pile to the bottom is made by continuous bearing of said hollow straight upper portion and said hollow tapered bottom portion.

2. In a pile as in claim 1, said convex polygon having 8 to 24 sides.

3. In a pile as in claim 2, said tapered portion being a unitary steel sheet folded into tapered polygon shape and having its longitudinally extending free edges welded together.

4. A driven pile in place in the ground and having the structure set forth in claim 3 and filled with concrete.

5. A driven pile in place in the ground and having the structure set forth in claim 2 and filled with concrete.

6. In a pile as in claim 1, said hollow straight upper portion, being a circular steel pipe attached to the top of said hollowed tapered bottom portion, the diameter of said pipe being no greater than an upper diameter of said bottom portion.

7. In a pile as in claim 6, said tapered portion being a unitary steel sheet folded into tapered regular polygon shape in cross-section and having its longitudinally free edges welded together.

8. A driven pile in place in the ground and having the structure set forth in claim 7 and filled with concrete.

9. A driven pile in place in the ground and having the structure set forth in claim 6 and filled with concrete.

10. In a pile as in claim 1, said tapered portion having a closure at its bottom to substantially prevent ingress of the soil into said tapered portion during the driving of the pile.

11. A driven pile in place in the ground and having the structure set forth in claim 10 and filled with concrete.

12. In a pile as in claim 1, said tapered portion is about 3 to 13 meters long and has a lower diameter which is about 200 mm to 400 mm and a larger upper diameter which is about 300 mm to 600 mm, and the thickness of the steel for the tapered portion being about 5 to 13 mm.

13. A driven pile in place in the ground and having the structure set forth in claim 12 and filled with concrete.

14. In a pile as in claim 12, said convex polygon having 8 to 24 sides.

15. In a pile as in claim 14, said tapered portion being a unitary steel sheet folded into tapered polygon shape and having its longitudinally extending free edges welded together, said straight portion being a steel pipe, said tapered portion having a closure at its bottom to substantially prevent ingress of the soil into said tapered portion during the driving of the pile.

16. A driven pile in place in the ground and having the structure set forth in claim 15 and filled with concrete.

17. A driven pile in place in the ground and having the structure set forth in claim 14 and filled with concrete.

18. A driven pile in place in the ground and having the structure set forth in claim 1 and filled with concrete.

19. A process which comprises the steps of driving a pile having (a) a hollow uniformly tapered bottom load-bearing portion for extended engagement with the soil into which the pile is to be driven and to be filled with concrete after driving and (b) a hollow straight upper load-bearing portion, wherein, said hollow tapered portion has a cross-section taken perpendicular to a longitudinal axis of said tapered bottom portion, which is a convex polygon having at least four sides, said sides being substantially equal in length, said hollow straight portion has a cross-section, taken perpendicular to a longitudinal axis, which is circular, the very top end of said hollow tapered portion being formed to a circular cross section of substantially the same diameter as, and matching with, the cross-section of said hollow straight portion and the bottom end of said hollow straight portion being butt-welded to said top of the hollow tapered portion so that the load transfer from the top of the pile to the bottom is made by continuous bearing of said hollow straight upper portion and said hollowed tapered bottom portion into granular soil by hammer blows transmitted to the top of said tapered bottom portion and then filling said hollow portions with concrete.

20. The process of claim 19, said polygon having 8 to 24 sides.

21. The process of claim 20, said tapered portion being a unitary steel sheet folded into tapered polygon shape and having its longitudinally extending free edges welded together.

22. The process of claim 19, said hollow straight upper portion being a circular steel pipe attached to the top of said hollow tapered bottom portion, the diameter of said pipe being no greater than an said upper diameter of said bottom portion.

23. The process of claim 22, said tapered portion being a unitary steel sheet folded into tapered regular polygon shape in cross-section and having its longitudinally free edges welded together.

24. The process of claim 19, said tapered portion having a closure at its bottom to substantially prevent ingress of the soil into said taped portion during the driving of the pile.

25. The process of claim 19, in which said tapered portion is about 3 to 13 meters long, and has a lower diameter which is about 200 mm to 400 mm, and a larger upper diameter which is about 300 mm to 600 mm, and the thickness of steel for the tapered portion is about 5 to 13 mm.

26. The process of claim 25 in which said convex polygon has 8 to 24 sides.

27. The process of claim 26 in which said tapered portion is a unitary steel sheet folded into tapered polygon shape and having its longitudinally extending free edges welded together, said straight portion is a steel pipe and said hammer blows are applied to the top of said pipe, said tapered portion having a closure at its bottom to substantially prevent ingress of the soil into said tapered portion during the driving of the pile.

* * * * *